US009646780B2

(12) United States Patent
Chao

(10) Patent No.: US 9,646,780 B2
(45) Date of Patent: May 9, 2017

(54) KEYSWITCH STRUCTURE

(71) Applicant: DARFON ELECTRONICS CORP., Taoyuan (TW)

(72) Inventor: Ling-Hsi Chao, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 21 days.

(21) Appl. No.: 14/791,223

(22) Filed: Jul. 2, 2015

(65) Prior Publication Data

US 2016/0064165 A1 Mar. 3, 2016

(30) Foreign Application Priority Data

Aug. 27, 2014 (TW) ..... 103129580 A

(51) Int. Cl.

*H01H 13/70* (2006.01)
*H01H 13/14* (2006.01)
*H01H 3/12* (2006.01)

(52) U.S. Cl.

CPC ..... *H01H 13/14* (2013.01); *H01H 3/122* (2013.01); *H01H 2221/024* (2013.01); *H01H 2227/036* (2013.01); *H01H 2235/00* (2013.01)

(58) Field of Classification Search

CPC .. H01H 3/00; H01H 3/02; H01H 3/12; H01H 3/26; H01H 3/70; H01H 3/7006; H01H 3/7013; H01H 3/702; H01H 3/705; H01H 2003/00; H01H 2201/00; H01H 2221/00; H01H 2239/056; H01H 5/00; H01H 5/04; H01H 13/70; H01H 13/14; H01H 2221/024; H01H 2227/036; H01H 2235/00

USPC ..... 200/5 A, 344, 314, 5 R, 46, 510–514, 200/520, 521, 308, 310, 311, 312, 313, 200/318.1, 337, 341, 343, 345

See application file for complete search history.

(56) References Cited

U.S. PATENT DOCUMENTS 5,382,762 A * 1/1995 Mochizuki ..... H01H 3/125 200/344
6,371,671 B1 * 4/2002 Sato ..... H01H 3/125 400/472

FOREIGN PATENT DOCUMENTS

| | | |
|---|---|---|
| CN | 102194592 A | 9/2011 |
| CN | 103065842 A | 4/2013 |
| TW | 454214 | 9/2001 |
| TW | 200425193 | 11/2004 |
| TW | 201246251 | 11/2012 |

(Continued)

*Primary Examiner* — Edwin A. Leon
*Assistant Examiner* — Anthony R. Jimenez
(74) *Attorney, Agent, or Firm* — Winston Hsu; Scott Margo

(57) ABSTRACT

The keyswitch structure uses two linkages form as V-shaped to support a keycap when the keycap is moved up and down. A first linkage and a second linkage are coupled with each other and also coupled with a support on a base respectively in a line contacting way, thereby forming a first axis, a second axis, and a third axis. The third axis is located between the first axis and the second axis. As the keycap is pressed to move downward, the keycap brings the two linkages and the support of the base to have relative rotation movement. Due to the geometric feature between the three axes, part of the linkages between the axes or the support of the base may be caused to slightly deform to provide a resilient restoring force that can move the keycap upward to a position not being pressed.

18 Claims, 9 Drawing Sheets

(56) References Cited

FOREIGN PATENT DOCUMENTS

| | | |
|---|---|---|
| TW | 201322293 | 6/2013 |

* cited by examiner

KEYSWITCH STRUCTURE

BACKGROUND OF THE INVENTION

1. Field of the Invention

The present invention relates to a keyswitch structure, and more particularly, to a keyswitch structure having a linkage device with virtual axes.

2. Description of the Prior Art

Keyboards are one of the necessary input apparatuses for inputting letters, symbols, or numbers when it comes to using a personal computer. Besides, both consumer electronic devices in our daily life or large machining equipment used for industry need keyswitch structure as the inputting apparatus in order to be operated or controlled.

A keyswitch structure in the prior art may primarily include a base, a keycap, and a lifting supporting device that connects the base and the keycap. As the keycap is supposed to be steady when moving up and down to properly function as pressing and activating a switch, a scissor structure is usually adapted as the supporting device. However, such scissor structure takes up more than a few conjunctions of components, which amounts to difficulty in assembling and complication in structure.

SUMMARY OF THE INVENTION

The present invention provides a keyswitch structure having a linkage device with virtual axes for solving the aforementioned drawbacks.

According to an embodiment of the present invention, a keyswitch structure includes a base, a keycap, a first linkage, and a second linkage. The base has a first supporting portion and a second supporting portion. The keycap is moveable up and down between a first position and a second position relative to the base. The first linkage has a first axis. The first linkage is rotatably coupled to the first supporting portion. An end of the first linkage slidably coupled to the keycap. The second linkage has a second axis. The second linkage is rotatably coupled to the second supporting portion. An end of the second linkage slidably coupled to the keycap. The other end of the first linkage rotatably engages with the other end of the second linkage, so as to forma third axis. The first axis is located between the two ends of the first linkage, and the second axis is located between the two ends of the second linkage. The first linkage has a first portion with a first length defined between the first axis and the third axis, the second linkage has a second portion with a second length defined between the second axis and the third axis, a distance between the first axis and the second axis is defined to be a third length, and a sum of the first length and the second length is greater than the third length. The first portion and the second portion are deformed to have a resilient restoring force when the keycap is pressed by an external force to move from the first position to the second position, and the resilient restoring force drives the keycap to move from the second position to the first position when the keycap is not pressed.

According to another embodiment of the present invention, a keyswitch structure includes a base, a keycap, a first linkage, a second linkage. The base has a first supporting portion and a second supporting portion. The keycap is movable up and down between a first position and a second position relative to the base. The first linkage has a first axis. The first linkage is rotatably coupled to the first supporting portion. An end of the first linkage is slidably coupled to the keycap. The second linkage has a second axis. The second linkage is rotatably coupled to the second supporting portion. An end of the second linkage is slidably coupled to the keycap. The other end of the first linkage rotatably engages with the other end of the second linkage, so as to forma third axis. The first axis is located between the two ends of the first linkage, and the second axis is located between the two ends of the second linkage. The first linkage has a first portion with a first length defined between the first axis and the third axis, the second linkage has a second portion with a second length defined between the second axis and the third axis, a distance between the first axis and the second axis is defined to be a third length, and a sum of the first length and the second length is greater than the third length. The first supporting portion and the second supporting portion are deformed to have a resilient restoring force when the keycap is pressed by an external force to move from the first position to the second position, and the resilient restoring force drives the keycap to move from the second position to the first position when the keycap is not pressed.

According to the embodiments of the present invention, a V-shaped structure is formed by the first linkage and the second linkage.

According to the embodiments of the present invention, the base further includes a restraining member, the restraining member abuts against the first linkage or the second linkage when the keycap moves up and down relative to the base, such that the first linkage and the second linkage are restrained from driving the keycap to move higher than the first position.

According to the embodiments of the present invention, the end of the first linkage and the end of the second linkage are respectively disposed inside the keycap and slidable relative to the keycap, the keycap has a restraining member on the path where the end of the first linkage or the end of the second linkage slides, the restraining member abuts against the end of the first linkage or the end of the second linkage when the keycap moves up and down relative to the base, such that the first linkage and the second linkage are restrained from driving the keycap to move higher than the first position, wherein cross sections of the first linkage and the second linkage are formed in Z shape.

According to the embodiments of the present invention, the first linkage and the second linkage are made of metal material or plastic material.

According to the embodiments of the present invention, the first axis is coupled with the first supporting portion in a line contacting manner, and the second axis is coupled with the second supporting portion in a line contacting manner.

According to the embodiments of the present invention, the first length is equal to the second length.

According to the embodiments of the present invention, the sum of the first length and the second length is greater than the third length by a value, and the resilient restoring force is set according to the value.

With the structure provided in the invention, no further resilient member is required for providing the resilient restoring force. Besides, the virtual axes formed by line contacting between the linkages and between the linkages and the base simplify the configuration of the axes, which reduces the overall thickness of the keyswitch structure and the number of the components.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
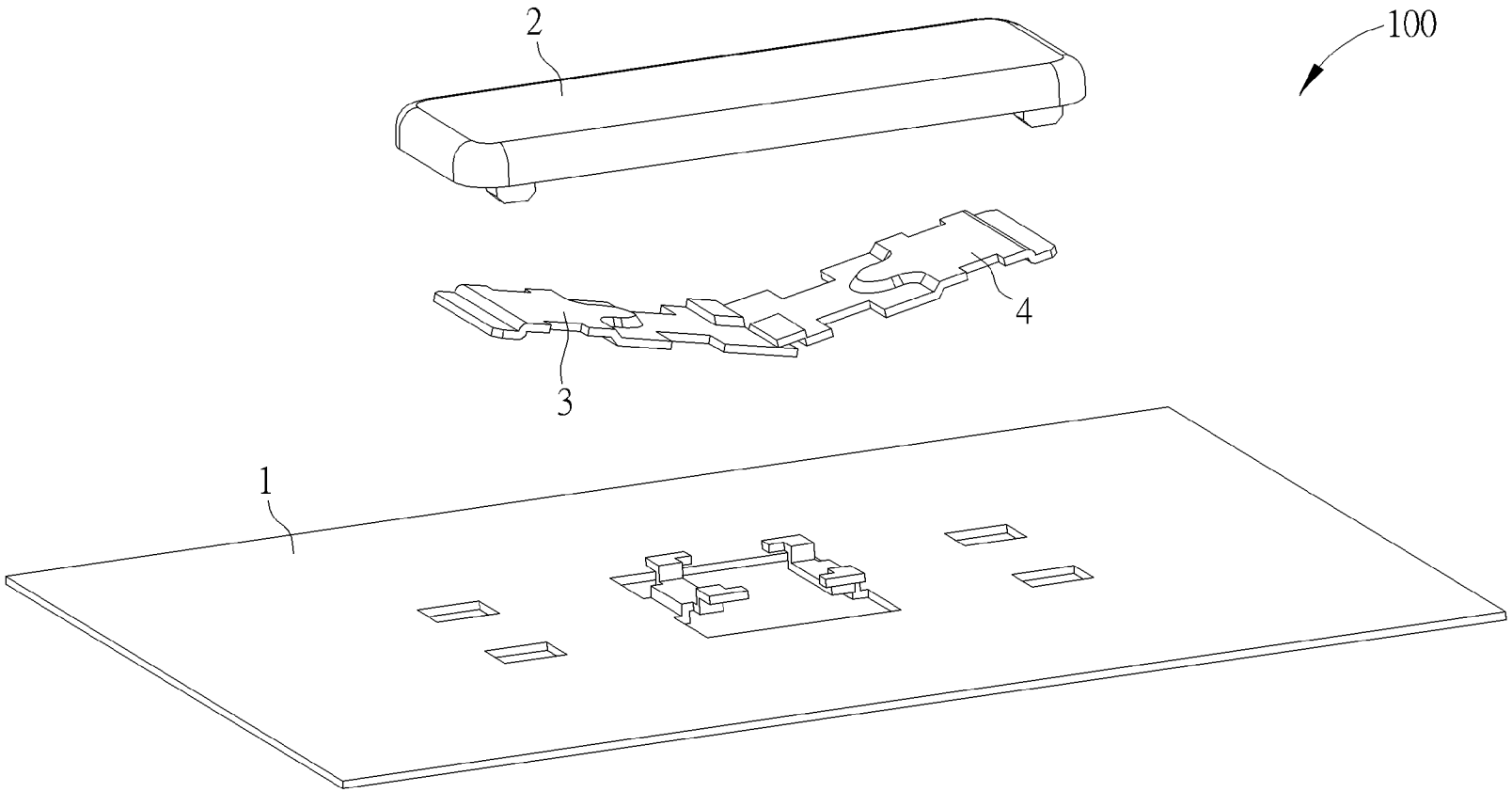
FIG. 1 is an exploded diagram of a keyswitch structure according to a first embodiment of the present invention.

Certain terms are used throughout the description and following claims to refer to particular components. As one skilled in the art will understand, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ." In addition, to simplify the descriptions and make it more convenient to compare between each embodiment, identical components are marked with the same reference numerals in each of the following embodiments. Please note that the figures are only for illustration and the figures may not be to scale.

Also, the term "couple" is intended to mean either an indirect or direct electrical/mechanical connection. Thus, if a first device is coupled to a second device, that connection may be through a direct electrical/mechanical connection, or through an indirect electrical/mechanical connection via other devices and connections.

Please refer to FIG. 1. FIG. 1 is an exploded diagram of a keyswitch structure 100 according to a first embodiment of the present invention. The keyswitch structure 100 includes a base 1, a keycap 2, a first linkage 3, and a second linkage 4. A V-shaped structure is formed by the first linkage 3 and the second linkage 4 and is disposed on the base 1. The keycap 1 is disposed on and supported by the first linkage 3 and the second linkage 4, and the keycap 2 of the keyswitch structure 100 is movable up and down relative to the base 1 when the keycap 2 is pressed.

Figure 2:
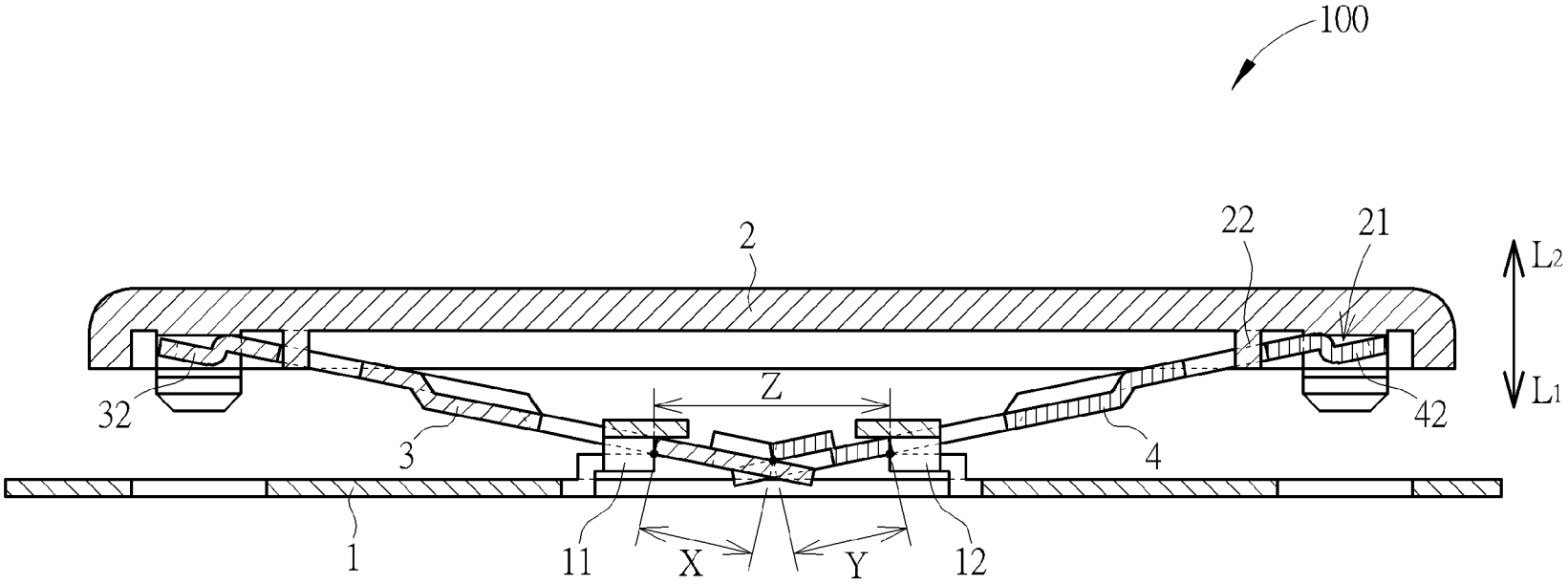
FIG. 2 is a diagram of a side sectional view of the keyswitch structure yet to be pressed according to the first embodiment of the present invention.
Figure 3:
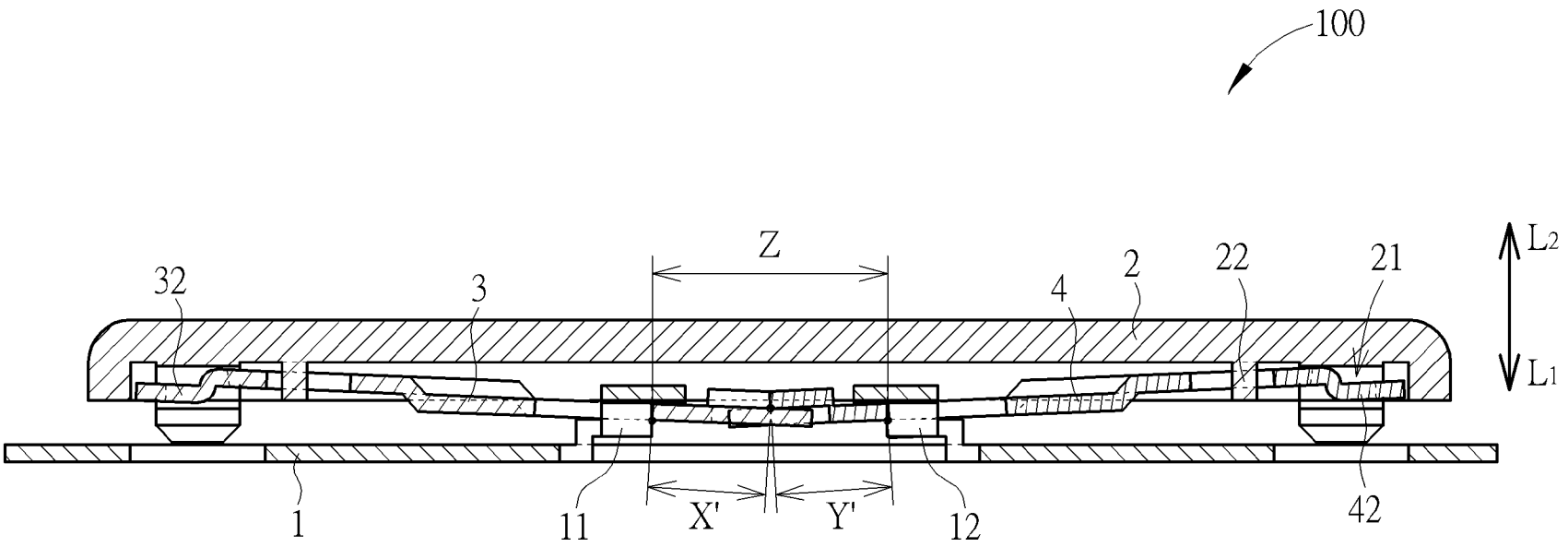
FIG. 3 is a diagram of a side sectional view of the keyswitch structure pressed according to the first embodiment of the present invention.
Figure 4:
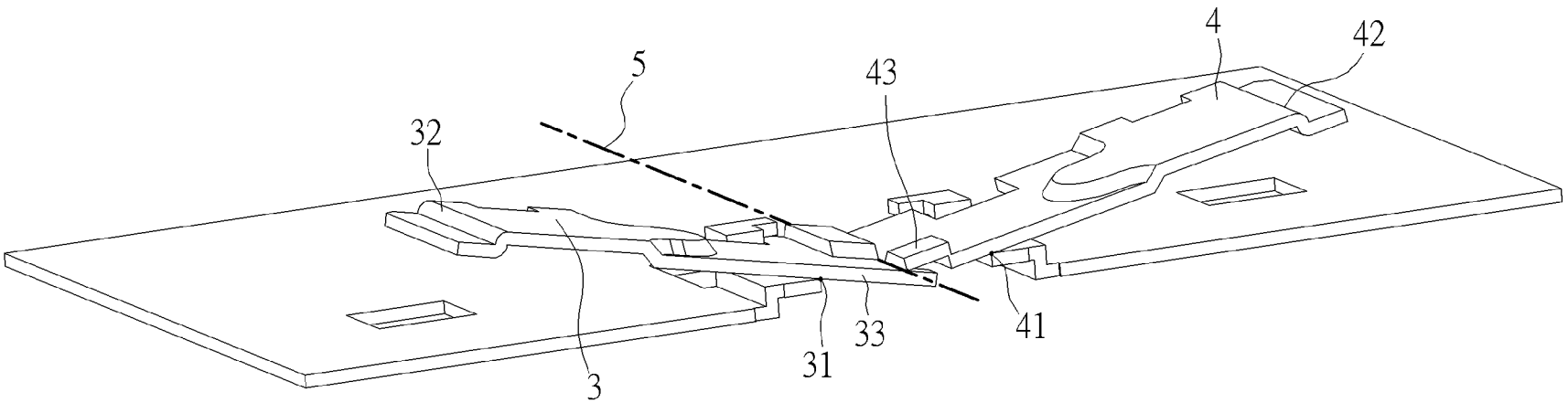
FIG. 4 is a diagram showing a perspective sectional view of a first linkage and a second linkage disposed on a base according to the first embodiment of the present invention.

Please refer to FIG. 2 and FIG. 3. FIG. 2 is a diagram of a side sectional view of the keyswitch structure 100 yet to be pressed according to the first embodiment of the present invention. FIG. 3 is a diagram of a side sectional view of the keyswitch structure 100 pressed according to the first embodiment of the present invention. As shown in FIG. 2, the keycap 2 is yet to be pressed and is located at a first position relative to the base 1. As shown in FIG. 3, the keycap 2 is pressed to move downwardly along a direction L1 to a second position relative to the base 1. Please refer to FIG. 2 to FIG. 4. FIG. 4 is a diagram showing a perspective view of the first linkage 3 and the second linkage 4 disposed on the base 1 according to the first embodiment of the present invention. An end 32 of the first linkage 3 and an end 42 of the second linkage 4 are slidably coupled to the keycap 2 respectively. The other end 33 of the first linkage 3 and the other end 43 of the second linkage 4 rotatably engage with each other. The base 1 has a first supporting portion 11 and a second supporting portion 12. The first linkage 3 is rotatably coupled to the first supporting portion 11, and a first axis 31 is formed on a location where the first linkage 3 is coupled to the first supporting portion 11. The second linkage 4 is rotatably coupled to the second supporting portion 12, and a second axis 41 is formed on a location where the second linkage 4 is coupled to the second supporting portion 12. A third axis 5 is formed on a location where the other end 33 of the first linkage 3 and the other end 43 of the second linkage 4 rotatably engage with each other. As shown in FIG. 4, the first linkage 3, the second linkage 4, and the base 1 of the keyswitch structure 100 of the present invention are coupled to one another in a line contacting manner. In other words, the first axis 31 is a contacting line between the first linkage 3 and the first supporting portion 11, the second axis 41 is a contacting line between the second linkage 4 and the second supporting portion 12, and the third axis 5 is a contacting line between the first linkage 3 and the second linkage 4, such that the three axes allow relative rotation movement between any two components between the first linkage 3, the second linkage 4, and the base 1 in a virtual axis manner. In summary, the ends 32, 42 of the first linkage 3 and the second linkage 4 are slidably coupled to the keycap 2 respectively, and the other ends 33, 43 of the first linkage 3 and the second linkage 4 are coupled with each other, so as to form the V-shaped structure. The first axis 31 cooperating with the base 1 is located between the two ends 32, 33 of the first linkage 3, and the second axis 41 is located between the two ends 42, 43 of the second linkage 4.

Please refer to FIG. 2 and FIG. 3. The first linkage 3 has a first portion with a first length X defined between the first axis 3 and the third axis 5. The second linkage 4 has a second portion with a second length Y defined between the second axis 4 and the third axis 5. A straight distance between the first axis 3 and the second axis 4 is defined to be a third length Z. As shown in FIG. 2, when the keycap 2 of the keyswitch structure 100 is yet to be pressed and is located at the first position, the geometric relation of an isosceles triangle is formed by the first length X, the second length Y, and the third length Z. That is, the first length X is equal to the second length Y, and the sum of the lengths (i.e., the first length X and the second length Y) of the first portion and the second portion is greater than the distance (i.e., the third length Z) between the first axis 31 and the second axis 41.

When the keycap 2 is pressed downwardly along the direction L1 from the first position as shown in FIG. 2 to the second position as shown in FIG. 3 by an external force, the geometric relation of the isosceles triangle as shown in FIG. 3 will not remain anymore since any axis, the first axis 31, the second axis 41, and the third axis 5, where any two components are interacting with each other can have mere rotation movement. In other words, distances between the three axes will change during the process that the keycap 2 is pressed downwardly to the second position, whereas in the first embodiment, the first portion of the first linkage 3 and the second portion of the second linkage 4 will deform to adapt to the distance change between the three axes. More specifically, as shown in FIG. 3, the first portion between the first axis 31 and the third axis 5 deforms to have length X' and the second portion between the second axis 41 and the third axis 5 deforms to have length Y', where the length X' is slightly shorter than the first length X and the length Y' is slightly shorter than the second length Y. Therefore, the deformed first portion and the deformed second portion have resilient restoring forces. When the keycap 2 is no longer pressed by the external force, the resilient forces drive the keycap 2 to move from the second position to the first position. In other words, the first portion of the first linkage 3 and the second portion of the second linkage 4 are slightly deformed to provide a mechanism for the keyswitch structure 100 to rebound upwardly along a direction L2 after the keyswitch structure 100 is pressed downwardly along the direction L1. In this embodiment, the first linkage 3 and the second linkage 4, which can be slightly deformed, can be made of metal material or plastic material.

It should be noted that since the sum of the first length X and the second length Y is greater than the third length Z, the resilient restoring force can be designed according to the relation between X, Y, and Z in practical applications, i.e., the sum of the first length X and the second length Y is greater than the third length Z by a value, and the resilient force is set according the value. For example, the bigger the value is, the bigger the resilient storing forces generated by the first portion of the first linkage 3 and the second portion of the second linkage 4 are when the keycap 2 is pressed to the second position.

Figure 5:
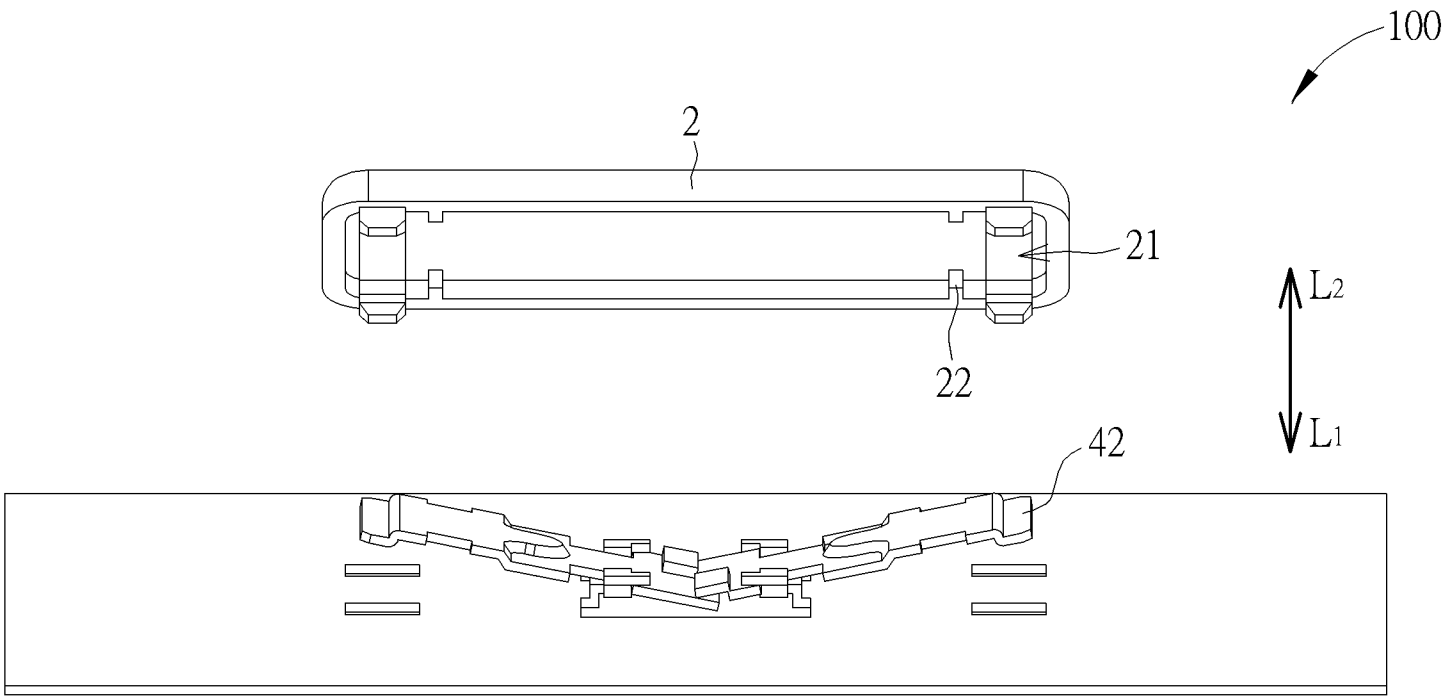
FIG. 5 is a diagram of a partial view of a keycap and the second linkage of the keyswitch structure according to the first embodiment of the present invention.

Please refer to FIG. 2 and FIG. 5. FIG. 5 is a diagram of a partial view of the keycap 2 and the second linkage 4 of the keyswitch structure 100 according to the first embodiment of the present invention. As mentioned above, the end 32 of the first linkage 3 and the end 42 of the second linkage 4 are slidably coupled to the keycap 2 respectively. More specifically, when the keycap 2 of keyswitch structure 100 is pressed or released to move up and down between the first position and the second position as shown in FIG. 2 and FIG. 3, the end 32 of the first linkage 3 and the end 42 of the second linkage 4 are located at slots 21 disposed inside and at two sides of the keycap 2 and slide relative to the keycap 2 horizontally. The keycap 2 has two restraining members 22 near the slots 21 and on the path where the end 32 of the first linkage 3 and the end 42 of the second linkage 4 slide. When the keycap 2 moves upwardly relative to the base 1 along the direction L2, the restraining members 22 can abut against the end 32 of the first linkage 3 and the end 42 of the second linkage 4 for restraining the first linkage 3 and the second linkage 4 from driving the keycap 2 to move higher than the first position shown in FIG. 2. Furthermore, the end 32 of the first linkage 3 and the end 42 of the second linkage 4 sliding in the slots 21 can have Z-shaped cross sections or thicker cross sections for abutting against an upper side and a lower side of the slot 21 of the keycap 2 respectively.

Figure 6:
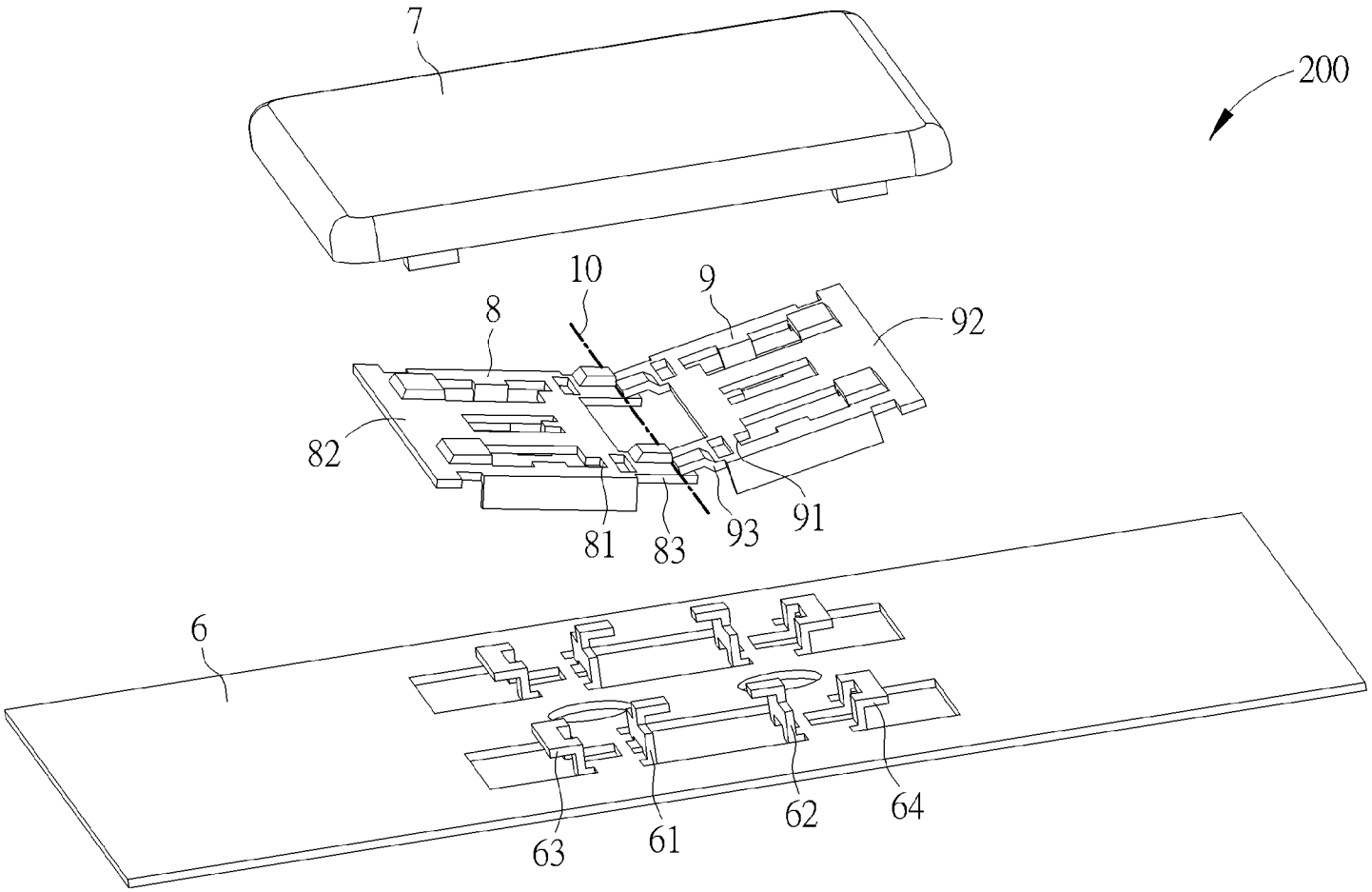
FIG. 6 is a diagram of an exploded view of a keyswitch structure according to a second embodiment of the present invention.
Figure 7:
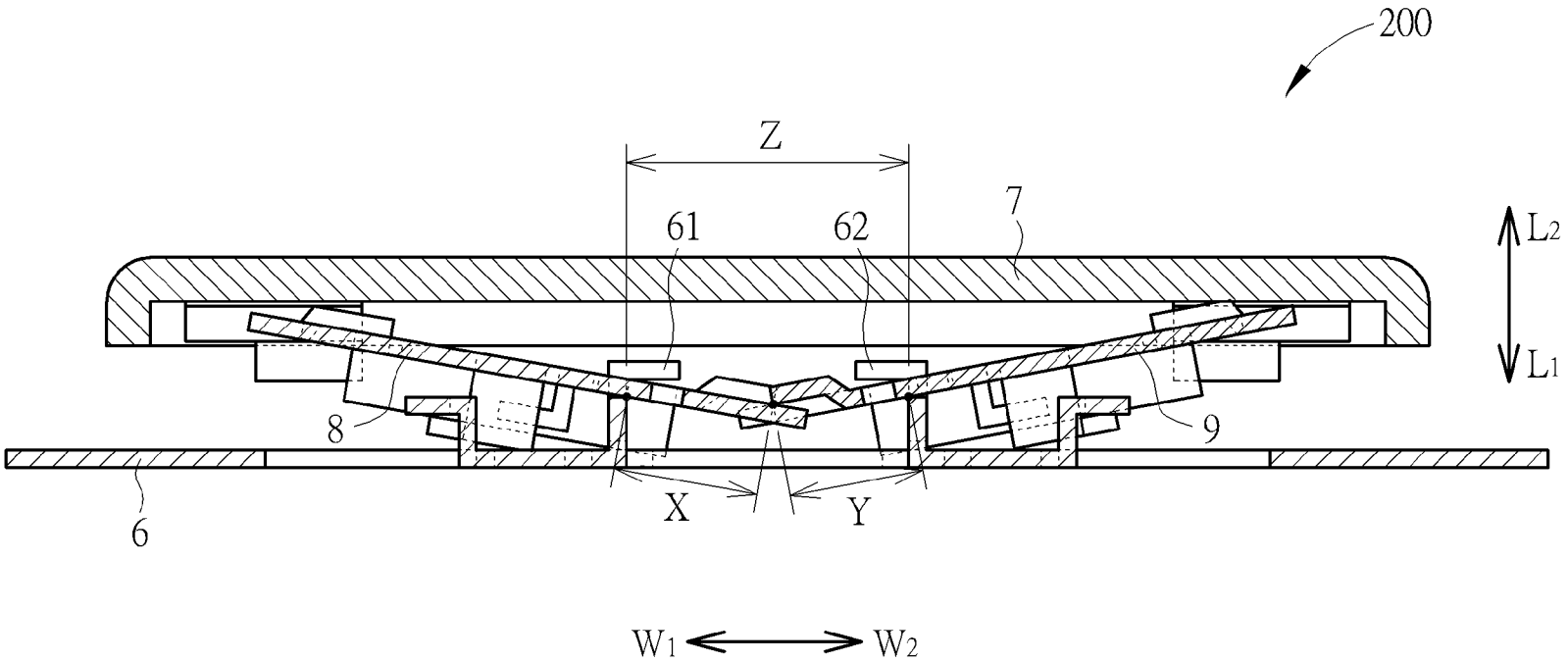
FIG. 7 is a diagram of a side sectional view of the keyswitch structure yet to be pressed according to the second embodiment of the present invention.

Please refer to FIG. 6 and FIG. 7. FIG. 6 is a diagram of an exploded view of a keyswitch structure 200 according to a second embodiment of the present invention. FIG. 7 is a diagram of a sectional view of the keyswitch structure 200 yet to be pressed according to the second embodiment of the present invention. Similar to the first embodiment mentioned above, the keyswitch structure 200 includes a base 6, a keycap 7, a first linkage 8, and a second linkage 9. A V-shaped structure is formed by the first linkage 8 and the second linkage 9. An end 82 of the first linkage 8 and the end 92 of the second linkage 9 are slidably coupled to the keycap 7 respectively. The other end 83 of the first linkage 8 and the other end 93 of the second linkage 9 rotatably engage with each other. The base 6 has a first supporting portion 61 and a second supporting portion 62. The first linkage 8 and the first supporting portion 61 are rotatably coupled, and a first axis 81 is formed on a location where the first linkage 8 and the first supporting portion 61 are coupled. The second linkage 9 and the second supporting portion 62 are rotatably coupled, and a second axis 91 is formed on a location where the second linkage 9 and the second supporting portion 62 are coupled. A third axis 10 is formed on a location where the other end 83 of the first linkage 8 and the other end 93 of the second linkage 9 rotatably engage with each other. The first linkage 8, the second linkage 9, and the base 6 of the keyswitch structure 200 are coupled with one another in a line contacting manner, such that the first axis 81, the second axis 91, and the third axis 10 allow any two components of the first linkage 8, the second linkage 9, and the base 6 to rotate in a virtual axis manner.

Figure 8:
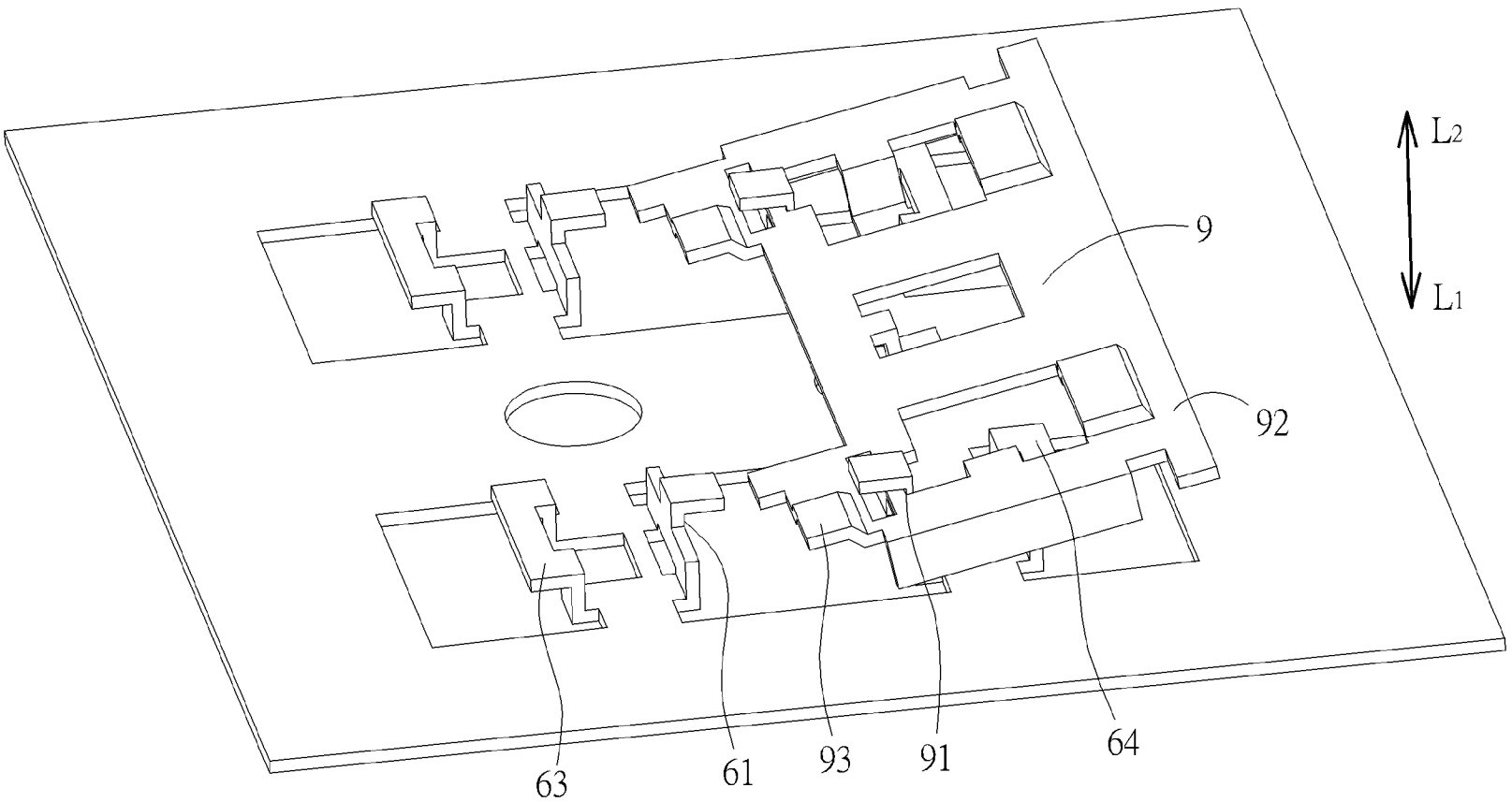
FIG. 8 is a diagram of the keyswitch structure as a second linkage is combined with the base according to the second embodiment.

Please refer to FIG. 7 and FIG. 8. FIG. 8 is a diagram of the keyswitch structure 200 as the second linkage 9 is combined with the base 6 according to the second embodiment. Similar to the first embodiment mentioned above, the first linkage 8 has a first portion with a first length X defined between the first axis 81 and the third axis 10. The second linkage 9 has a second portion with a second length Y defined between the second axis 91 and the third axis 10. A straight distance between the first axis 81 and the second axis 91 is defined to be a third length Z. The geometric relation of an isosceles triangle is formed by the first length X, the second length Y, and the third length Z.

Different from the first embodiment, although the distances between the first axis 81, the second axis 91, and the third axis 10 also change during the process that the keycap 7 is pressed downwardly along the direction L1 by an external force, it is the first supporting portion 61 and the second portion 62 of the base 6 that will deform to adapt to the distance change between the three axes in the second embodiment. More specifically, the first supporting portion 61 shown in FIG. 6 is driven by the first linkage 8 to slightly deform and move leftwardly along a direction W1. The second supporting portion 62 is driven by the second linkage 9 to slightly deform and move rightwardly along a direction W2. In such a way, under the condition that the first portion of the first linkage 8 remains the first length X and the second portion of the second linkage 9 remains the second length Y, the distance between the first axis 81 and the second axis 91 is slightly greater than the third length Z. Therefore, the deformed first supporting portion 61 and the deformed second supporting portion 62 have resilient restoring forces. In this embodiment, the first supporting portion 61 and the second supporting portion 62 of the base 6, which can be slightly deformed, can be made of metal material or plastic material and can be integrally formed with the base 6, as shown in FIG. 6, or disposed on the base 6 in an independent manner.

Figure 9:
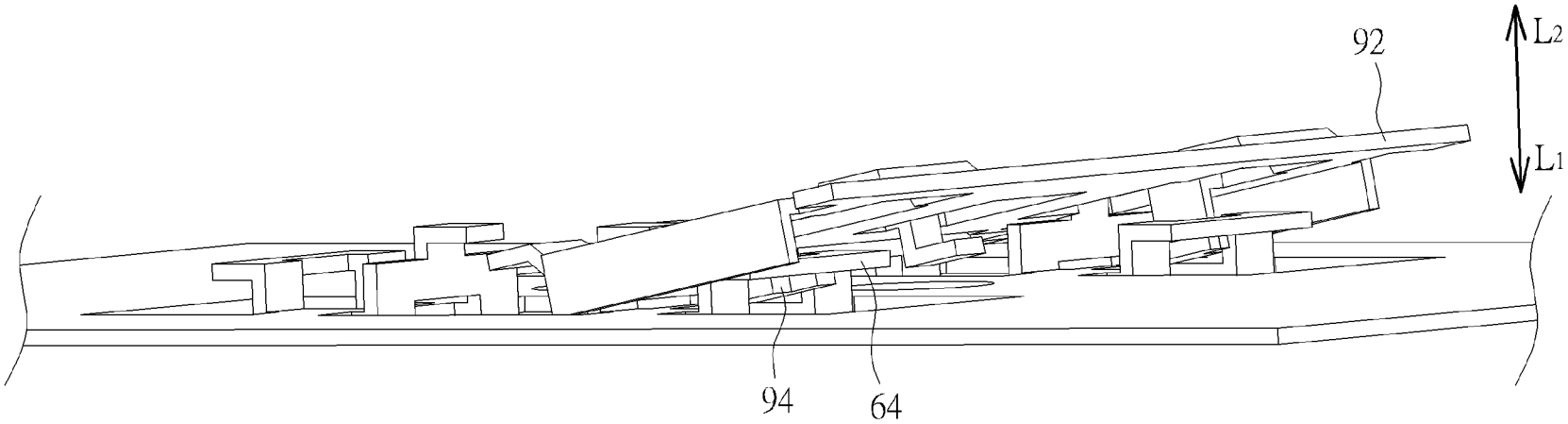
FIG. 9 is a diagram showing another perspective view of the components in FIG. 8 according to the second embodiment of the present invention.

Please refer to FIG. 8 and FIG. 9. FIG. 9 is a diagram showing another perspective view of the components in FIG. 8 according to the second embodiment of the present invention. In the second embodiment, the keyswitch structure 200 also has at least one restraining structure for restraining upward displacement of the keycap 7, i.e., the base 6 further includes two restraining members 63, 64 having L-shaped hooks extending outwardly and with openings. The second linkage 9 has an abutting portions 94 extending toward the opening of the L-shaped hook of the restraining member 64. The first linkage 8 and the second linkage 9 have identical structure, and therefore the first linkage 8 is not shown in figures and description is omitted herein. When the keycap 7 moves upwardly relative to the base 6 along the direction L2, the restraining member 63, 64 can abut against the abutting portion of the first linkage 8 and the abutting portion 94 of the second linkage 9 for restraining the first linkage 8 and the second linkage 9 from driving the keycap 7 to move higher than a position shown in FIG. 7.

In contrast to the prior art, the keyswitch structure uses two linkages form as V-shaped to support the keycap when the keycap is moved up and down. The first linkage and the second linkage are coupled with each other and also coupled with the support on the base respectively in a line contacting way, thereby forming the first axis, the second axis, and the third axis. The third axis is located between the first axis and the second axis. As the keycap is pressed to move downward, the keycap brings the two linkages and the support of the base to have relative rotation movement. Due to the geometric feature between the three axes, part of the linkages between the axes or the support of the base may be caused to slightly deform to provide the resilient restoring force that can move the keycap upward to the position not being pressed, such that the present invention is not required to further utilize the resilient member for providing the resilient restoring force. Besides, the virtual axes formed between the linkages and base can simplify the configuration of the axes, which reduces the overall thickness of the keyswitch structure and the number of the components.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a base having a first supporting portion and a second supporting portion;

a keycap moveable up and down between a first position and a second position relative to the base;

a first linkage having a first axis, the first linkage rotatably coupled to the first supporting portion, an end of the first linkage slidably coupled to the keycap; and a second linkage having a second axis, the second linkage rotatably coupled to the second supporting portion, an end of the second linkage slidably coupled to the keycap;

wherein another end of the first linkage rotatably engages with the another end of the second linkage, so as to form a third axis, the first axis is located between the end and the another end of the first linkage, and the second axis is located between the end and the another end of the second linkage;

wherein the first linkage has a first portion with a first length defined between the first axis and the third axis, the second linkage has a second portion with a second length defined between the second axis and the third axis, a distance between the first axis and the second axis is defined to be a third length, and a sum of the first length and the second length is greater than the third length;

wherein the end of the first linkage and the end of the second linkage slide relative to the keycap when the keycap moves between the first position and the second position relative to the base, the first portion and the second portion are deformed to have a resilient restoring force when the keycap is pressed by an external force to move from the first position to the second position, and the resilient restoring force drives the keycap to move from the second position to the first position when the keycap is not pressed.

2. The keyswitch structure of claim 1, wherein a V-shaped structure is formed by the first linkage and the second linkage.

3. The keyswitch structure of claim 1, wherein the base further comprises a restraining member, the retraining member abuts against the first linkage or the second linkage when the keycap moves up and down relative to the base, such that the first linkage and the second linkage are restrained from driving the keycap to move higher than the first position.

4. The keyswitch structure of claim 1, wherein the first linkage and the second linkage are made of metal material or plastic material.

5. The keyswitch structure of claim 1, wherein the first axis is coupled with the first supporting portion in a line contacting manner, and the second axis is coupled with the second supporting portion in a line contacting manner.

6. The keyswitch structure of claim 1, wherein the first length is equal to the second length.

7. The keyswitch structure of claim 1, wherein the sum of the first length and the second length is greater than the third length by a value, and the resilient restoring force is set according to the value.

8. The keyswitch structure of claim 1, wherein the end of the first linkage and the end of the second linkage are respectively disposed inside the keycap and slidable relative to the keycap, the keycap has a restraining member on a path where the end of the first linkage or the end of the second linkage slides, the restraining member abuts against the end of the first linkage or the end of the second linkage when the keycap moves up and down relative to the base, such that the first linkage and the second linkage are restrained from driving the keycap to move higher than the first position.

9. The keyswitch structure of claim 8, wherein cross sections of the first linkage and the second linkage are formed in a Z-shape.

10. A keyswitch structure, comprising:

a base having a first supporting portion and a second supporting portion;

a keycap movable up and down between a first position and a second position relative to the base;

a first linkage having a first axis, the first linkage rotatably coupled to the first supporting portion, an end of the first linkage slidably coupled to the keycap; and a second linkage having a second axis, the second linkage rotatably coupled to the second supporting portion, an end of the second linkage slidably coupled to the keycap;

wherein another end of the first linkage rotatably engages with the another end of the second linkage, so as to form a third axis, the first axis is located between the end and the another end of the first linkage, and the second axis is located between the end and the another end of the second linkage;

wherein the first linkage has a first portion with a first length defined between the first axis and the third axis, the second linkage has a second portion with a second length defined between the second axis and the third axis, a distance between the first axis and the second axis is defined to be a third length, and a sum of the first length and the second length is greater than the third length;

wherein the end of the first linkage and the end of the second linkage slide relative to the keycap when the keycap moves between the first position and the second position relative to the base, the first linkage and the second linkage respectively drive the first supporting portion and the second supporting portion to be oppositely deformed to have a resilient restoring force when the keycap is pressed by an external force to move from the first position to the second position, and the resilient restoring force drives the keycap to move from the second position to the first position when the keycap is not pressed.

11. The keyswitch structure of claim 10, wherein a V-shaped structure is formed by the first linkage and the second linkage.

12. The keyswitch structure of claim 10, wherein the base further comprises a restraining member, the retraining member abuts against the first linkage or the second linkage when the keycap moves up and down relative to the base, such that the first linkage and the second linkage are restrained from driving the keycap to move higher than the first position.

13. The keyswitch structure of claim 10, wherein the first linkage and the second linkage are made of metal material or plastic material.

14. The keyswitch structure of claim 10, wherein the first axis is coupled with the first supporting portion in a line contacting manner, and the second axis is coupled with the second supporting portion in a line contacting manner.

15. The keyswitch structure of claim 10, wherein the first length is equal to the second length.

16. The keyswitch structure of claim 10, wherein the sum of the first length and the second length is greater than the third length by a value, and the resilient restoring force is set according to the value.

17. The keyswitch structure of claim 10, wherein the end of the first linkage and the end of the second linkage are respectively disposed inside the keycap and slidable relative to the keycap, the keycap has a restraining member on a path that the end of the first linkage or the end of the second linkage slides, the restraining member abuts against the end of the first linkage or the end of the second linkage when the keycap moves up and down relative to the base, such that the first linkage and the second linkage are restrained from driving the keycap to move higher than the first position.

18. The keyswitch structure of claim 17, wherein cross sections of the first linkage and the second linkage are formed in a Z-shape.

* * * * *